US010207146B2

(12) United States Patent
Liao et al.

(10) Patent No.: US 10,207,146 B2
(45) Date of Patent: Feb. 19, 2019

(54) TREADMILL WHICH CAN BE DRIVEN IN BOTH DIRECTIONS

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech. Co., Ltd., Taichung (TW)

( * ) Notice: Subject to any disclaimer, the term of this patent is extended or adjusted under 35 U.S.C. 154(b) by 0 days.

(21) Appl. No.: 15/445,995

(22) Filed: Mar. 1, 2017

(65) Prior Publication Data

US 2018/0250552 A1 Sep. 6, 2018

(51) Int. Cl.

| | |
|---|---|
| ***A63B 71/00*** | (2006.01) |
| ***A63B 22/02*** | (2006.01) |
| ***A63B 24/00*** | (2006.01) |
| ***A63B 22/00*** | (2006.01) |
| *A63B 71/06* | (2006.01) |

(52) U.S. Cl.

CPC ..... *A63B 22/025* (2015.10); *A63B 22/0015* (2013.01); *A63B 24/0087* (2013.01); *A63B 71/0054* (2013.01); *A63B 71/0622* (2013.01); *A63B 2022/0278* (2013.01); *A63B 2071/0081* (2013.01)

(58) Field of Classification Search

None

See application file for complete search history.

(56) References Cited

U.S. PATENT DOCUMENTS

| | | | | |
|---|---|---|---|---|
| 5,690,587 | A * | 11/1997 | Gruenangerl | A63B 22/02 482/54 |
| 6,676,569 | B1 * | 1/2004 | Radow | A63B 22/0235 482/4 |
| 6,733,423 | B1 * | 5/2004 | Chang | A63B 22/02 482/51 |
| 7,846,070 | B2 * | 12/2010 | Oglesby | A63B 22/0023 482/51 |
| 8,394,002 | B2 * | 3/2013 | Park | A63B 21/0053 482/51 |
| 8,480,541 | B1 * | 7/2013 | Brunts | A63B 22/0242 482/1 |
| 9,943,722 | B2 * | 4/2018 | Dalebout | A63B 24/0062 |
| 2009/0176629 | A1 * | 7/2009 | Yi | A63B 22/0242 482/54 |

* cited by examiner

*Primary Examiner* — Stephen R Crow

(57) ABSTRACT

The present invention provides a treadmill for allowing an exerciser to perform walking or running exercise on an endless belt. The treadmill is selected to be operated in a forward movement mode or in a reverse movement mode. In the reverse movement mode, a control unit of the treadmill controls a driving device to drive a top surface of the endless belt to slide forward for allowing the exerciser to simulate backward walking. When a detecting device detects that the exerciser enters a warning area in front of a normal range of movement, a reaction mechanism would be triggered to control the driving device to slow down or stop the endless belt. In the forward movement mode, the control unit controls the driving device to drive the top surface of the endless belt to slide backward and to disable the reaction mechanism.

10 Claims, 9 Drawing Sheets

TREADMILL WHICH CAN BE DRIVEN IN BOTH DIRECTIONS

BACKGROUND

1. Field of the Invention

The present invention relates to an exercise apparatus. More particularly, the present invention relates to a treadmill which can be driven in both directions.

2. Description of the Related Art

In the field of physical exercise and rehabilitation, treadmills are common exercise apparatuses for fitness or rehabilitation. Generally, every treadmill has an exercise platform (or running board) and an endless belt mounted around the exercise platform for walking or running in the same place. In most electric treadmills, a driving device for driving the endless belt is generally mounted on the front end of the exercise platform, and a console as a user interface is located above the front end of the platform. The console is provided with a control unit electrically connected to the driving device for controlling the driving device in accordance with a preset program or an immediate command, so that the endless belt is rotated at a predetermined speed for allowing an exerciser to walk, jog, or run at a speed matching that of the endless belt. In general, when the treadmill is used, the motor in the driving device is operated in a rotational direction such as a positive rotational direction, and the endless belt is rotated circularly in a predetermined direction, namely the endless belt is moved to the rear for allowing the exerciser to simulate forward walking or running toward the front (the console) of the treadmill.

On the other hand, compared to normal forward walking, backward walking on the ground has some benefits such as less joint load, large muscle activity, easy to buffer the foot, training for different parts of muscles. Therefore, some people may use a treadmill to perform the similar exercise to achieve the same effect, that is, in a conventional treadmill, the endless belt is controlled to be rotated at a slow speed, and the exerciser stands on the endless belt but faces the rear of the treadmill (namely the back towards the console), since the top surface of the endless belt continuous to slide forward from the rear of the exerciser at this time, so that the exerciser is able to simulate walking backward in this state. In fact, some treadmills already provide an operation mode for performing backward walking (hereinafter referred to as reverse movement mode). In the reverse movement mode, the control unit controls the motor of the driving device to rotate in a rotational direction opposite to the positive rotational direction, and driving the endless belt to rotate in a reverse rotational direction, namely the top surface of the endless belt is moved to the front end from the rear end of the exercise platform so as to allow the exerciser to perform backward walking and keep facing the front of the treadmill.

Referring to the safety of the treadmill in the forward movement mode, during exercise of walking or running on the treadmill, if the exerciser is exhausted or distracting, the speed of walking or running may be slower than the backward speed of the endless belt, the exerciser will fall back with respect to the platform. Once the exerciser backs to the end of the platform, the exerciser may slip away or fall from the platform. In order to avoid such accident, generally, an emergency switch and/or a safety clip are provided on the console of the treadmill. The emergency switch provides the exerciser to actively actuate in an emergency. When the emergency is triggered, the control unit will control the driving device to stop driving the endless belt. The safety clip is used to be secured on the front of the exerciser's clothes, and a rope with a predetermined length is connected between the safety clip and the console. When the exerciser backs excessively out of a preset distance and pulls the rope backward to actuate the emergency switch, the control unit will control the driving device to stop driving the endless belt. Furthermore, the treadmill may use infrared, ultrasound, step sensing, image recognition or other means to detect the position of the exerciser on the platform for setting safety mechanisms.

Then discuss the safety of backward walking on the treadmill. When the top surface of the endless belt is moved forward from the rear of the exerciser, if the speed of backward walking is slower than the speed of the endless belt, the exerciser will move forward with respect to the platform. It is not recommend using a conventional treadmill without reverse movement mode to perform backward walking, since the exerciser faces toward the rear of the treadmill so that the exerciser is hard to press the emergency switch in an emergency.

On the other hand, regarding to the treadmill having a reverse movement mode, the top surface of the endless belt is moved to the front end from the rear end of the exercise platform during backward walking. If the speed of backward walking is slower than the speed of the endless belt, the exerciser will approach the console at the front of the treadmill. If the exerciser does not come back in time, the body of the exerciser may hit the console and the feet may be pushed forward to the cover of the driving device at the front of exercise platform and thus stumbles on the endless belt. Of course, the exerciser can actively press the emergency switch, but it cannot expect to press the emergency switch in time.

The present invention has arisen to mitigate and/or obviate the disadvantages of the conventional method. Further benefits and advantages of the present invention will become apparent after a careful reading of the detailed description with appropriate reference to the accompanying drawings.

SUMMARY

The present invention is directed to a treadmill that is capable of being selected to be operated in a forward movement mode or in a reverse movement mode. The forward movement mode is provided for allowing an exerciser facing the front of the treadmill to simulate movement of forward walking or forward running. The reverse movement mode is provided for allowing the exerciser facing the front of the treadmill to simulate movement of backward walking. The aforementioned treadmill provides a safety mechanism as the exerciser performs the movement of backward walking.

According to one aspect of the present invention, a treadmill which can be driven in both directions comprises a platform, a driving device, a detecting device and a control unit. The platform has a frame and an endless belt mounted around the frame. The endless belt defines an exercise surface which is slidable in a longitudinal direction for allowing a user to perform walking or running. The platform defines a warning area located more forward than a center of the exercise surface. The driving device has a motor coupled to the endless belt for driving the endless belt to rotate. The detecting device is configured for detecting whether the user enters the warning area or not. The control unit is electrically connected to the driving device and the detecting device. The control unit is configured to control the driving device to drive the endless belt to rotate in a predetermined rotational direction at a predetermined rotational speed. The control unit has a reaction mechanism such that when the detecting device detects that the user enters into the warning area, the control unit controls the driving device to slow down or stop the endless belt. The treadmill is selected to be operated in a forward movement mode or in a reverse movement mode. In the forward movement mode, the control unit controls the driving device to drive the exercise surface of the endless belt to slide backward and to disable the reaction mechanism. In the reverse movement mode, the control unit controls the driving device to drive the exercise surface of the endless belt to slide forward and enable the reaction mechanism.

Further benefits and advantages of the present invention will become apparent after a careful reading of the detailed description with appropriate reference to the accompanying drawings.

DETAIL DESCRIPTION

Figure 1:
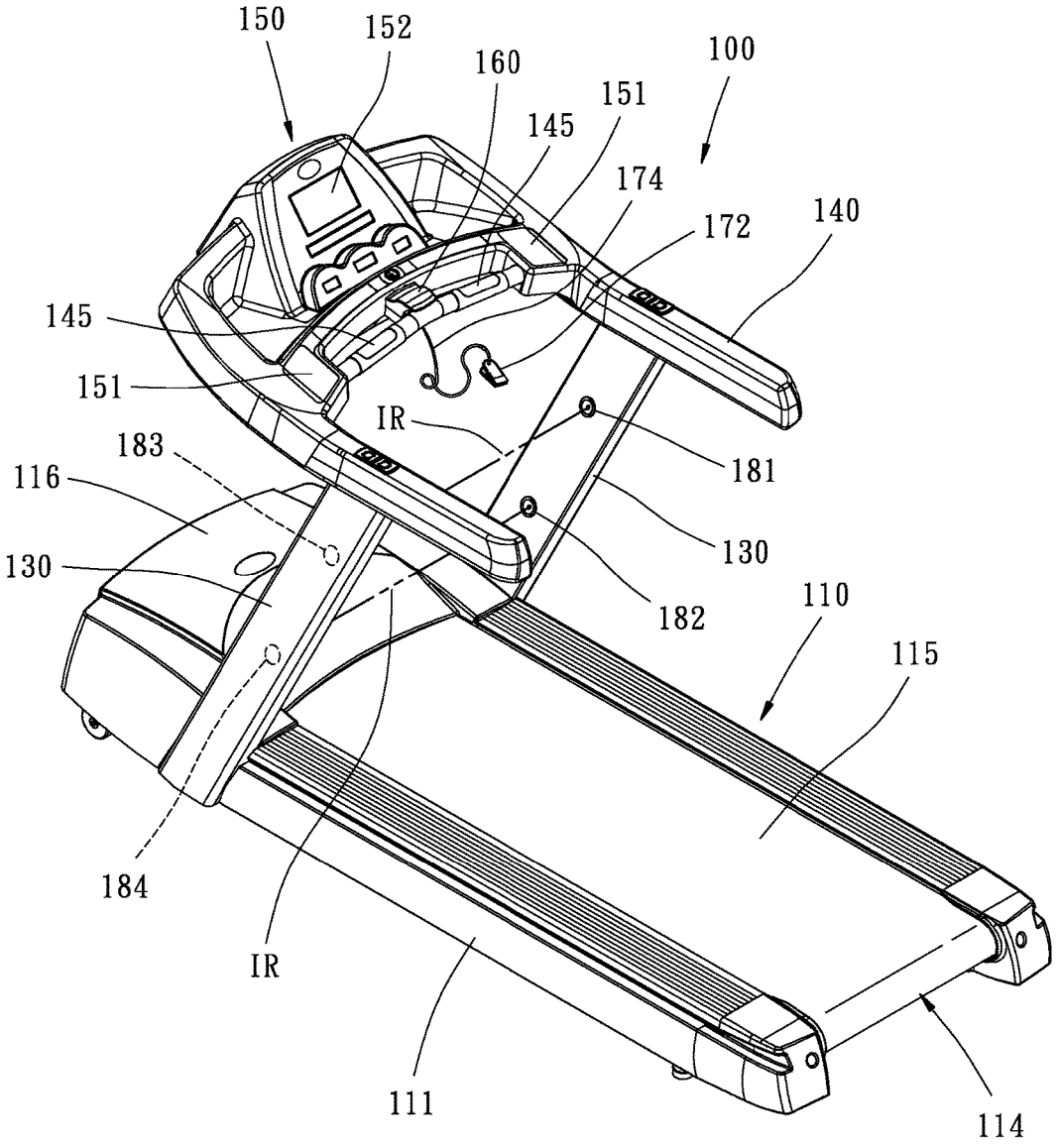
FIG. 1 is a perspective view of a treadmill in accordance with a first preferred embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Referring to FIG. 1 through FIG. 4, a treadmill 100 is illustrated in accordance with a first preferred embodiment of the present invention. The treadmill 100 is basically the same as a conventional treadmill in appearance configuration. The treadmill 100 includes a platform 110, two uprights 130 extending upwardly from left and right sides of the platform 110, two handrails 140 respectively mount to the top ends of the two uprights 130, and a console 150.

Figure 3:
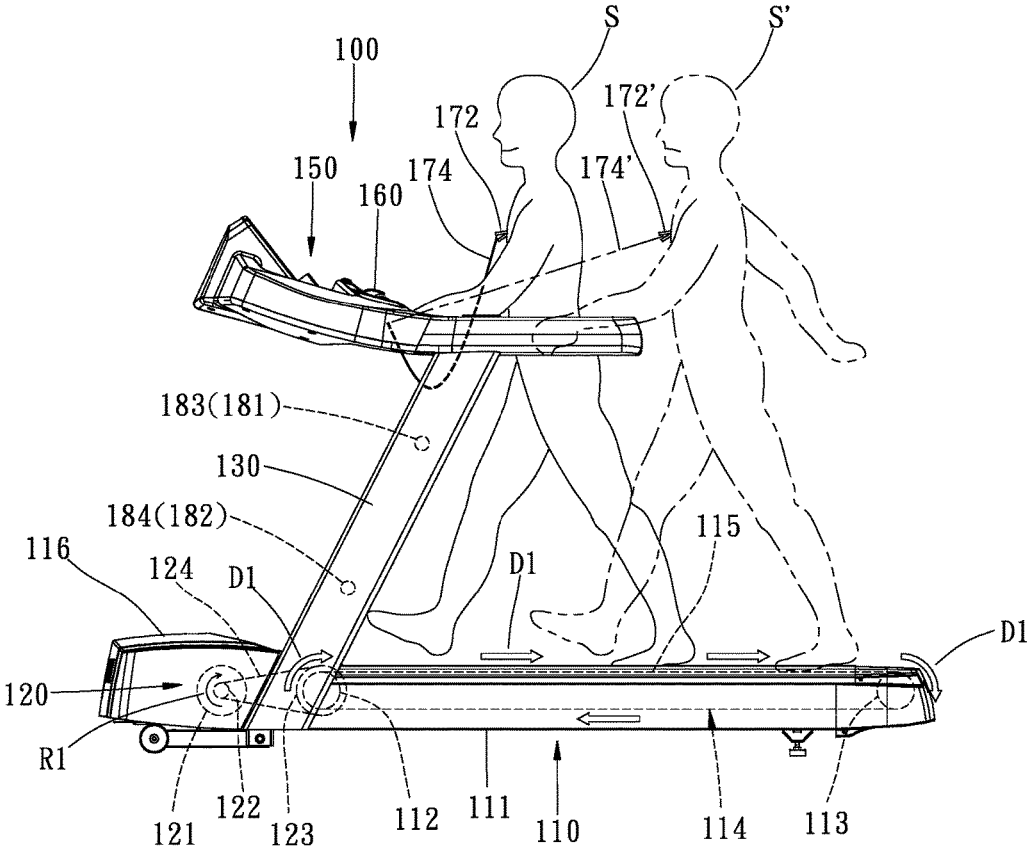
FIG. 3 is a side view of the treadmill shown in FIG. 1 for illustrating that the treadmill is operated in a forward movement mode.
Figure 4:
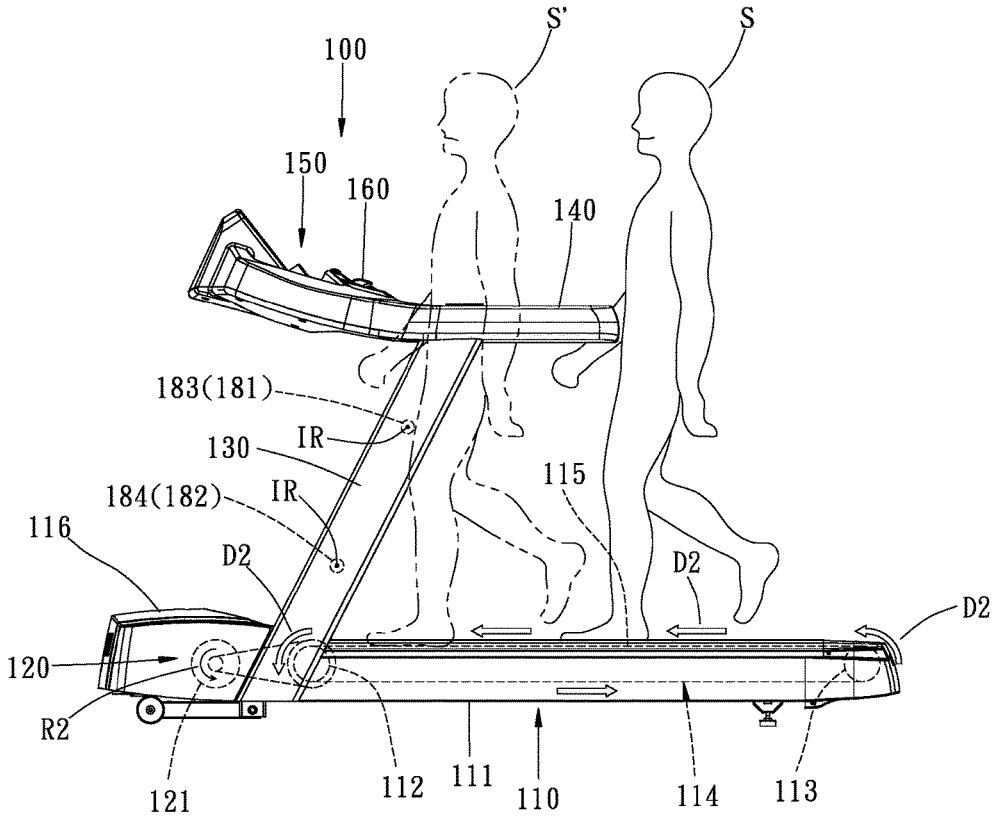
FIG. 4 is a side view of the treadmill shown in FIG. 1 for illustrating that the treadmill is operated in a reverse movement mode.

The platform 110 has a substantially rectangular frame 111 which has two ends corresponding to the front and rear ends of the treadmill 100. A rectangular deck (or running board, not shown) is sustained on the frame 111 by a plurality of elastic support members or damping elements (not shown). A front roller 112 and a rear roller 113 are pivotally and transversely mounted on the frame 111 and disposed at a front side and a rear side of the deck respectively, as shown in FIG. 3 and FIG. 4. An endless belt 114 is mounted around the front roller 112 and the rear roller 13 with an appropriate tightness and across the top and the bottom of the deck, so that the endless belt 114 can be circularly revolved around the frame 111. The upper surface of the endless belt 114 forms an exercise surface 115 which is slidable in a longitudinal direction for supporting an exerciser S and allowing the exerciser S to walk or run on the exercise surface 115 in one place.

Generally, most treadmill platforms can be electrically or manually adjusted the inclined angle with respect to the ground, so that the user can adjust the exercise surface to a level state or a predetermined inclined angle for simulating movement on a level ground or on different slopes, respectively. The treadmill of the present invention may also employ a movable platform capable of being angled. Actually, the front end of the platform 110 in the present embodiment is provided with an electric control mechanism (not shown) for changing the angle of the platform 110, and the detailed description is not mentioned in the present invention. The exercise surfaces in the drawings are presented at a horizontal state for illustrating the typical use of the treadmill, which is not limited in the present invention. In other words, when the treadmill of the present invention is used, either simulating forward movement or simulating backward movement, the exercise surface of the platform may be adjusted to a level state, an inclined state that the front end is higher than the rear end, or an inclined state that the front end is lower than the rear end according to the use requirement.

The platform 110 has a protecting cover 116 disposed at the front end thereof for covering the electric control mechanism that is provided to change the angle of the platform 110 and covering a driving device 120 that is configured to drive the endless belt to rotate and the correlated power system. The driving device 120 includes a motor 121 coupled to the endless belt 114. Like a conventional transmission method, a small belt pulley 122 is coupled to the motor shaft of the motor 121, a large belt pulley 123 is coupled to one end of the front roller 112, and a driving belt 124 is mounted around the two belt pulleys 122, 123. Thereby, as shown in FIG. 3, when the motor 121 is controlled to run in a positive rotational direction R1 (such as clockwise direction in the figures), and the front roller 112 is rotated in the same direction at a lower rotational speed and a higher torsion for driving the endless belt 114 to be rotated in a positive rotational direction D1, so that the exercise surface 115 is moved backward to the rear. In contrast, as shown in FIG. 4, when the motor 121 is controlled to run in a reverse rotational direction R2 (such as counterclockwise direction in the figures), and the front roller 112 is rotated in the same direction at a lower rotational speed and a higher torsion for driving the endless belt 114 to be rotated in a reverse rotational direction D2 opposite to the positive rotational direction, so that the exercise surface 115 is moved forward to the front. The driving device in the present invention can make use of any conventional technique which is capable of driving the endless belt to rotate, and it is normally a motor capable of being driven in both directions.

Two lower ends of the two symmetric uprights 130 are respectively mounted to the left and right sides of the frame 111 of the platform 110 corresponding to the front end of the exercise surface 115. In the present embodiment, each of the two uprights 130 extends upward and rearward from the platform 110 (about 60 degrees tilt), in other words, the closer to the top of each upright 130 the closer to the rear.

Figure 2:
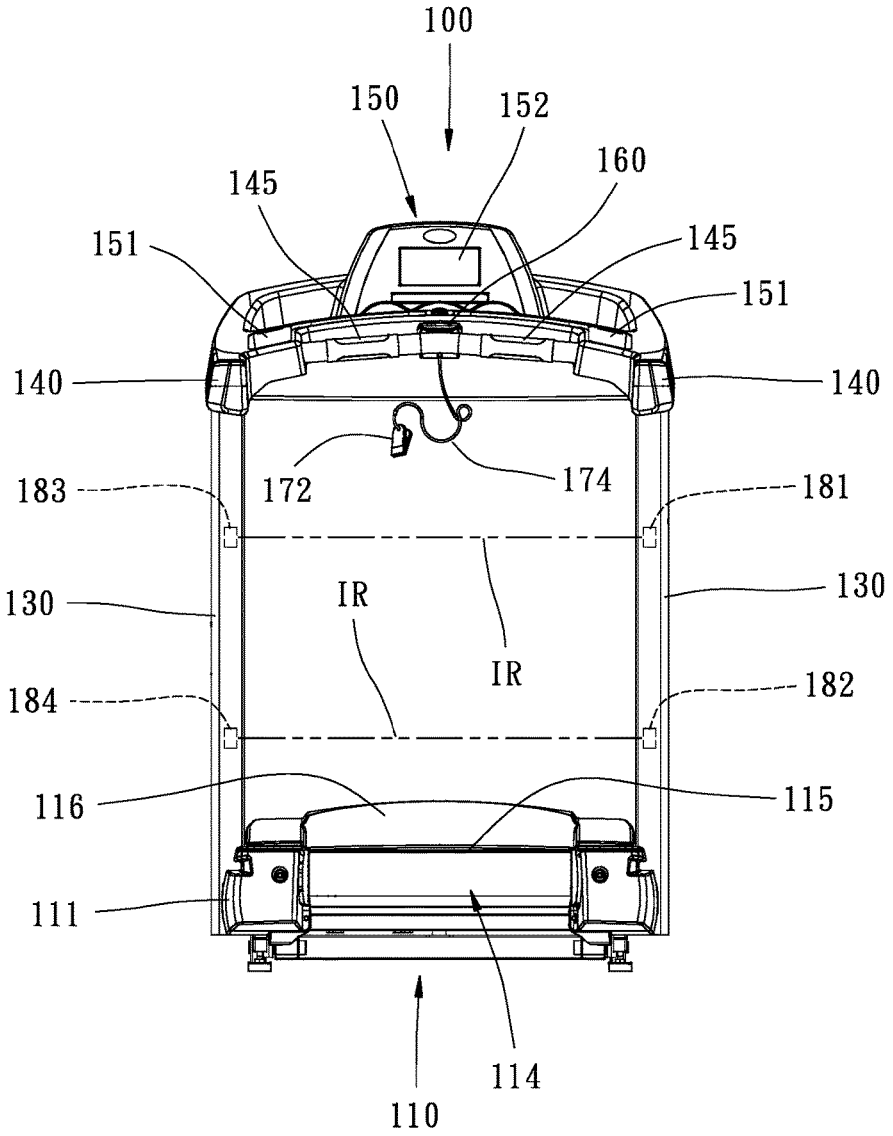
FIG. 2 is a rear elevational view of the treadmill shown in FIG. 1.

In the preferred embodiment of the present invention. The right upright 130 has an upper infrared emitter 181 and a lower infrared emitter 182 disposed in an inner side thereof, and the left upright 130 has an upper infrared receiver 183 and a lower infrared receiver 184 disposed in an inner side thereof. The upper infrared emitter 181 is opposite to the upper infrared receiver 183 at a height substantially corresponding to a tight range as an ordinary person stands on the exercise surface 115. The lower infrared emitter 182 is opposite to the lower infrared receiver 184 at a height substantially corresponding to a shank range as an ordinary person stands on the exercise surface 115. The lower infrared emitter 182 and the lower infrared receiver 184 are located more forward than the upper infrared emitter 181 and the upper infrared receiver 183. As shown in FIG. 1 and FIG. 2, the infrared emitters 181, 182 at the right upright 130 can respectively emit infrared rays (IR) to the left, and the infrared receivers 183, 184 can respectively receive the infrared rays (IR) from the corresponding infrared emitters 181, 182 if the infrared rays (IR) are not interrupted. In other words, when the infrared emitter 181/182 emits an infrared ray (IR) and the corresponding infrared receiver 183/184 is not received, it indicates that there is an object between them.

The two symmetric handrails 140 are respectively secured to the top ends of the left and right uprights 130, and each extends horizontally in a longitudinal direction at a height substantially corresponding to the waist or abdomen of an ordinary person for allowing the exerciser S to hold anytime. In another embodiment, the left and right handrails may extend to the rear end of the platform, namely the length of the handrails at two sides of the treadmill corresponds to the length of the exercise surface.

The console 150 is secured between the front ends of the left and right handrails 140, and located above the protecting cover 116 at the front end of the platform 110. The console 150 includes a plurality of input interfaces 151 and a display interface 152 disposed thereof. The input interfaces 151 are provided for allowing the exerciser S to manually input commands, and the display interface 152 is provided to display information for the exerciser S.

On the rear side of the console close to the handrails 140 and the exerciser S, there are two handles 145 extended transversely at a position substantially above the front end of the exercise surface 115 and located at a height which is the same as the handrails 140 for allowing the exerciser S to reach his hands out to grasp the left and right handles 145, if needed.

As shown in FIG. 1, an emergency switch 160 is disposed at a central position of the rear side of the console 150. In the present embodiment, a reciprocating switch (or a temporary switch) is used, and a large deflection-type pressing cap is defined at the top of the emergency switch 160 so that the exerciser S can press the pressing cap to actuate the emergency switch 160 manually to stop the treadmill 100 in an emergency. Furthermore, a safety clip 172 is connected to one end (rear end) of a rope 174 with a predetermined length, and the other end (front end) of the rope 174 is connected to the pressing cap under the emergency switch 160. When the rope 174 is pulled backward, the pressing cap is pulled to actuate the emergency switch 160. However, the emergency switch 160 and the safety clip 172 are conventional techniques that are well known in the art. The treadmill of the present invention may use other emergency switches of the prior art in place of the structure described above. For example, the emergency switch may use an alternative switch (or a locking switch), a touch switch or a proximity sensor, or even an emergency switch installed in a wired or wireless controller which could be held by the exerciser. On the other hand, the front end of the rope which is connected to the safety clip may be connected to the console in a detachable manner (e.g. using a pin or magnet), and a switch circuit is triggered when the rope is pulled back and out of the console. The term "triggering" of a switch involves causing an electronic circuit to be short-circuited or open-circuited, or to change the electrical state from one level to another, such as a change in voltage, current, resistance or capacitance.

The console 150 has a control unit therein (not shown). The control unit refers to a hardware, software and firmware assembly that can process a variety of electrical signals of the treadmill in a predetermined manner. In practice, a microcontroller (MCU) with a built-in specific program is generally used as the processing core, and the related circuits and components are integrated on one or a plurality of circuit boards. The control unit is electrically connected to the electric control mechanism (for changing the angle of the platform 110, not shown), the driving device 120, the input interface 151, the display interface 152, the emergency switch 160, the infrared emitters 181, 182 and the infrared receivers 183, 184. The control unit is able to control the driving circuit of the motor 121 of the driving device 120, such as commanding the motor 121 to start or stop operation and to control the rotational direction and rotational speed of the operation, that is, making the driving device 120 drive the endless belt 114 to rotate in the predetermined rotational direction (namely the positive rotational direction D1 or the reverse rotational direction D2) and the predetermined rotational speed. Besides, the control unit may also receive and process instructions or data from the input interface 151, control the display content of the display interface 152, receive circuit signals from the emergency switch 160 (monitor whether it is triggered), control the infrared emitters 181, 182 to emit infrared rays, and receive circuit signals from the infrared receivers 183, 184 (for monitoring whether they receive infrared rays or not).

The treadmill 100 can be selected to be operated in a forward movement mode or in a reverse movement mode. In brief, the forward movement mode is provided for the exerciser S to simulate the movement of forward walking or forward running, and the reverse movement mode is provided for the exerciser S to simulate the movement of backward walking (even backward running). The exerciser S can use the input interface 151 on the console 150 to select an exercise mode he wants. In the forward movement mode, as shown in FIG. 3, the control unit controls the driving device 120 to drive the endless belt 114 to be rotated in the positive rotational direction D1, namely driving the exercise surface 115 to move backward to the rear, and requiring the exerciser S to move forward to match exercise surface 115. In the reverse movement mode, as shown in FIG. 4, the control unit controls the driving device 120 to drive the endless belt 114 to be rotated in the reverse rotational direction D2, namely driving the exercise surface 115 to move forward to the front, and requiring the exerciser S to move backward to match the exercise surface 115.

FIG. 3 illustrates that the treadmill 100 is operated in the forward movement mode, and the exerciser S on the exercise surface 115 simulates a forward walk toward the front side of the treadmill 100. As shown in the figure, the exerciser S has secured the safety clip 172 in the proper position on the front of his clothes prior to exercise based on the correct instruction. In the forward movement mode, whether walking or running, the body of the exerciser S is generally located in the front half or the middle position of the space above the exercise surface 115, so that the feet of the exerciser S maintain a safety distance from the rear edge of the exercise surface 115 (e.g. approximately one-third of the length of the exercise surface 115), and the rope 174 of the safety clip 170 is in a relaxed and sagging state. If the exerciser S is exhausted or distracting during exercise, the speed of walking or running may be slower than the backward speed of the exercise surface 115, and the exerciser S will fall back with respect to the platform 110. Since the safety clip 172 is fixed to the exerciser S, the backward movement of the exerciser S would pull the rope 174 backward. When the exerciser S backs to the pre-warning position where a danger may occur (as shown in the phantom lines of the exerciser's location S' in FIG. 3), that is, when the rope 174 of the safety clip 170 is fully straightened (as shown in the phantom lines of the clip 172' and the rope 174'), the front end of the rope 174 will trigger the emergency switch 160. When the control unit detects that the emergency switch 160 is triggered, the motor 121 of the driving device 120 is stopped immediately, and the endless belt 114 is stopped in a short time to avoid accidents.

In the above mechanism, the safety clip 172, the rope 174 and the circuit of the emergency switch 160 constitute a first detecting device for detecting whether or not the exerciser S enters a preset warning area (hereinafter referred to as first warning area) behind the normal range of movement. In short, the first detecting device is configured to detect whether the upper body of the exerciser S (the position where the safety clip 172 is secured to) enters the posterior approximately one-third of the space above the exercise surface 115. When the first detecting device detects the exerciser S entering the first warning area, it will transmit an electrical signal to the control unit, or the control unit may obtain or determine the detection result based on an electrical state of the first detecting device.

Of course, the exerciser S can manually press the emergency switch 160 by hands to make the driving device 120 stop driving the endless belt 114 immediately if the exerciser S himself feels dangerous or needs to stop movement immediately during exercise. However, like some treadmills in the prior art, the treadmill of the present invention may be only provided with a safety clip set (or other detectors that can detect an excess of the backward movement of the exerciser) without an emergency switch. In contrast, like some treadmills in the prior art, the treadmill of the present invention may be only provided with an emergency switch without a safety clip set (or other detectors that can detect an excess of the backward movement of the exerciser), namely the exerciser needs to stop operation of the treadmill himself via the emergency switch.

FIG. 4 illustrates that the treadmill 100 is operated in the reverse movement mode, and the exerciser S on the exercise surface 115 faces the front side of the treadmill 100 to simulate backward walking. In the reverse movement mode, the exerciser S does not need to attach the aforementioned safety clip 172. In contrast to the forward movement mode, the body of the exerciser S who is walking backward is generally located in the rear half or the middle position of the space above the exercise surface 115, so that the feet of the exerciser S maintain a safety distance (e.g. approximately one-third of the length of the exercise surface 115) from the front edge of the exercise surface 115 (or the boundary between the exercise surface 115 and the protecting cover 116). When the treadmill 100 is operated in the reverse movement mode, the control unit controls the infrared emitters 181, 182 on the right upright 130 to emit infrared rays (IR), and monitoring whether the infrared receivers 183, 184 on the left upright 130 receive the infrared rays (IR). If the exerciser S is exhausted or distracting during exercise, the speed of walking or running may be slower than the forward speed of the exercise surface 115, and the exerciser S will go forward with respect to the platform 110. When the exerciser S moves forward to the pre-warning position where a danger may occur (as shown in the phantom lines of the exerciser's location S' in FIG. 4), and the legs of the exerciser S will enter the area between the left and right uprights 130 to interrupt the infrared rays (IR) from infrared emitters 181, 182 at the right side, so that the infrared receivers 183, 184 at the left side do not receive the infrared rays (IR) temporarily. When the control unit monitors that any infrared receiver 183/184 does not receive any infrared ray, the motor 121 of the driving device 120 is stopped immediately, and the endless belt 114 is stopped in a short time to avoid accidents.

In the above mechanism, the infrared emitters 181, 182 and the infrared receivers 183, 184 constitute a second detecting device for detecting whether or not the exerciser S enters a preset warning area (hereinafter referred to as second warning area) in front of the normal range of movement. In short, the second detecting device is configured to detect whether legs of the exerciser S (there may be hands or other parts of the body) enter the area between the left and right uprights 130. When the second detecting device detects the exerciser S entering the second warning area, it will transmit an electrical signal to the control unit, or the control unit may obtain or determine the detection result based on an electrical state of the second detecting device. In the preferred embodiment of the present invention, two pairs of infrared sets are arranged on the inner sides of the two upright 130 to generate two infrared rays at different positions for detection. One of the two infrared rays is arranged higher and more rearward, and the other infrared ray is arranged lower and more forward in order to avoid missing detection and improve reliability. In another embodiment of the present invention (not shown), it may provide more pairs of infrared sets on the uprights 130, or maybe provide only one pair of infrared set arranged at a key position. However, it is not necessary to make the infrared rays arranged in a left-right axial direction. For example, an infrared emitter may be disposed at the bottom of the console 150, and a corresponding infrared receiver is disposed at the top of the protecting cover 116, so that the infrared ray for detection is presented longitudinal.

Likewise, in the reverse movement mode, in addition to the detection of the second detecting device for stopping the treadmill 100 in an emergency, the exerciser S can manually press the emergency switch 160 by hands to make the driving device 120 stop driving the endless belt 114 immediately if the exerciser S himself feels dangerous or needs to stop movement immediately during exercise. However, the treadmill of the present invention may not be provided without an emergency switch.

It should be noted that the infrared emitters 181, 182 and the infrared receivers 183, 184, namely the second detecting device, are not operated in the forward movement mode as shown in FIG. 3. Of course, the control unit does not control the driving device 120 to stop running according to the detection result of the second detecting device. As shown in FIG. 3, in the forward movement mode, when the exerciser S is walking or running in the normal range of movement, the legs or hands may pass into the space between the left and right uprights 130, that is, the second warning area in the reverse movement mode may overlap the normal range of the exercising movement in the forward movement mode or close to the front end of the normal exercising range. There is no need to control to stop the endless belt since it is normal or common phenomenon that the exerciser enters into the second warning area.

Figure 5:
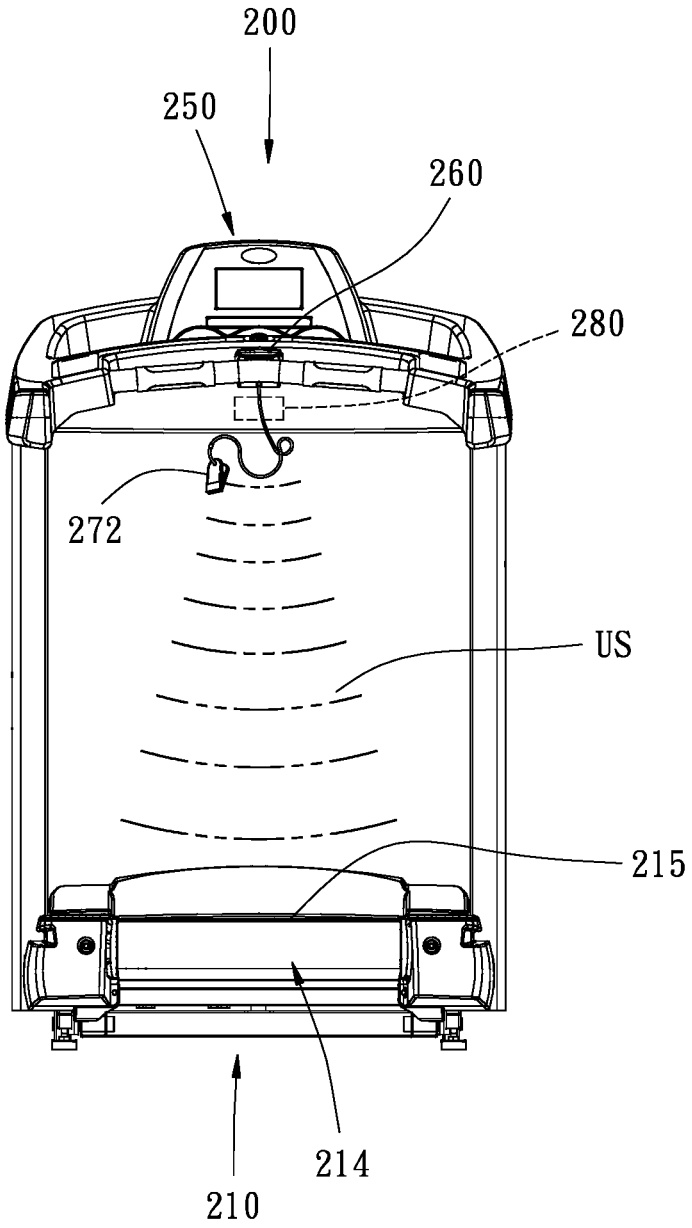
FIG. 5 is a rear elevational view of a treadmill in accordance with a second preferred embodiment of the present invention.
Figure 6:
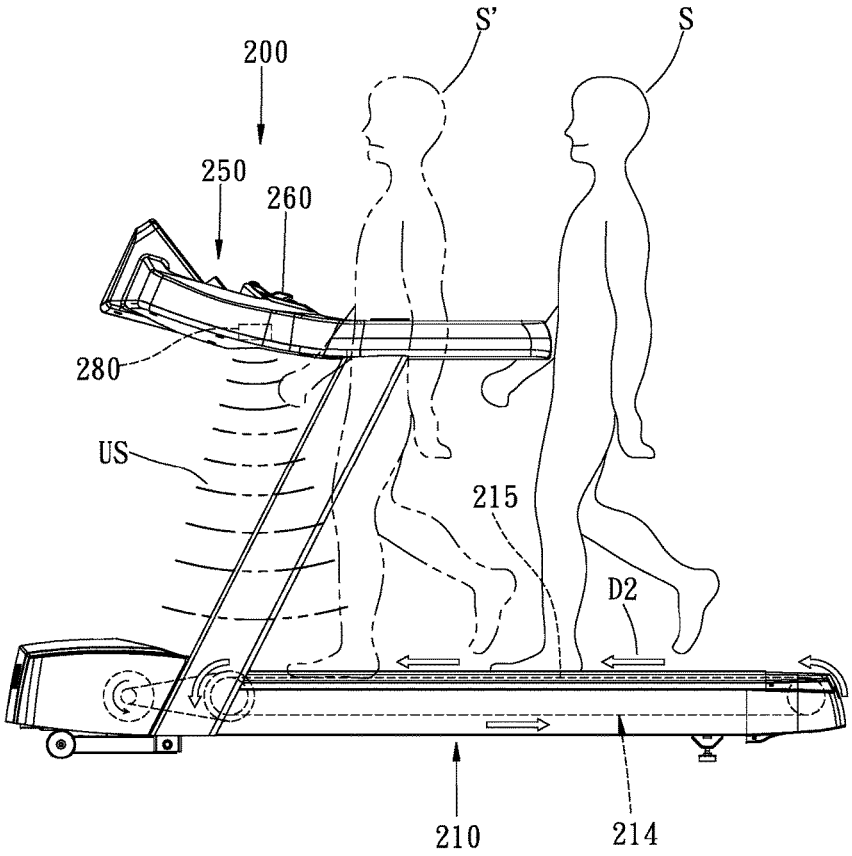
FIG. 6 is a side view of the treadmill shown in FIG. 5 for illustrating that the treadmill is operated in a reverse movement mode.

Referring to FIG. 5 and FIG. 6, a treadmill 200 is illustrated in accordance with a second preferred embodiment of the present invention. The second embodiment is similar to the first embodiment, except that the left and right uprights are not provided with infrared emitting/receiving components. Instead, an ultrasonic module 280 is disposed at the central position of the bottom of the console 250 and electrically connected to the control unit. The aforementioned ultrasonic module is a conventional modular device (e.g. a "reversing radar" that is commonly used in automobiles), which incorporates a component for emitting ultrasound and a component for receiving ultrasound. The ultrasonic module 280 can emit ultrasound (US) downward from the bottom of the console 250. The ultrasound (US) will be reflected back as an object in the path of the ultrasound (US) within a distance and received by the ultrasonic module 280 so as to obtain the distance of the object by measuring the elapsed time of the ultrasound (US) reflected back to the ultrasonic module 280. In this application, it is able to determine whether the exerciser enters into the warning area below the console 250 or not. As shown in FIG. 6, when the treadmill 200 is operated in a reverse movement mode, the control unit controls the ultrasonic module 280 to emit ultrasound (US), and to monitor the reflection status of the ultrasound (US). When the exerciser S keeps in a safety position for performing backward walking on the platform 210, it will not interfere with the ultrasound (US). When the exerciser S is located forward excessively (as shown in the phantom lines of the exerciser's location 5' in FIG. 6), the hands or legs will reflect the ultrasound (US) back to the ultrasonic module 280 to make the control unit determine that the exerciser S enters the warning area and control the driving device to stop running. The treadmill 200 of the present embodiment also has an emergency switch 260 and safety clip 272 (first detecting device) as the first embodiment. Similarly, the ultrasonic module 280 (second detecting device) of the treadmill 200 is not operated in a forward movement mode as described previously.

According to one aspect of the present invention, in a particular embodiment, the treadmill of the present invention has a detecting unit. The detecting unit includes a first detecting function and a second detecting function. The first detecting function is provided for detecting whether the exerciser enters the first warning area at the rear part of the space above the platform. The second detecting function is provided for detecting whether the exerciser enters the second warning area at the front part of the space above the platform. In the aforementioned first and second embodiments, the first detecting function is achieved by a first detecting device such as safety clip set, and the second detecting function is achieved by a second detecting device such as infrared sets or an ultrasonic module.

Figure 7:
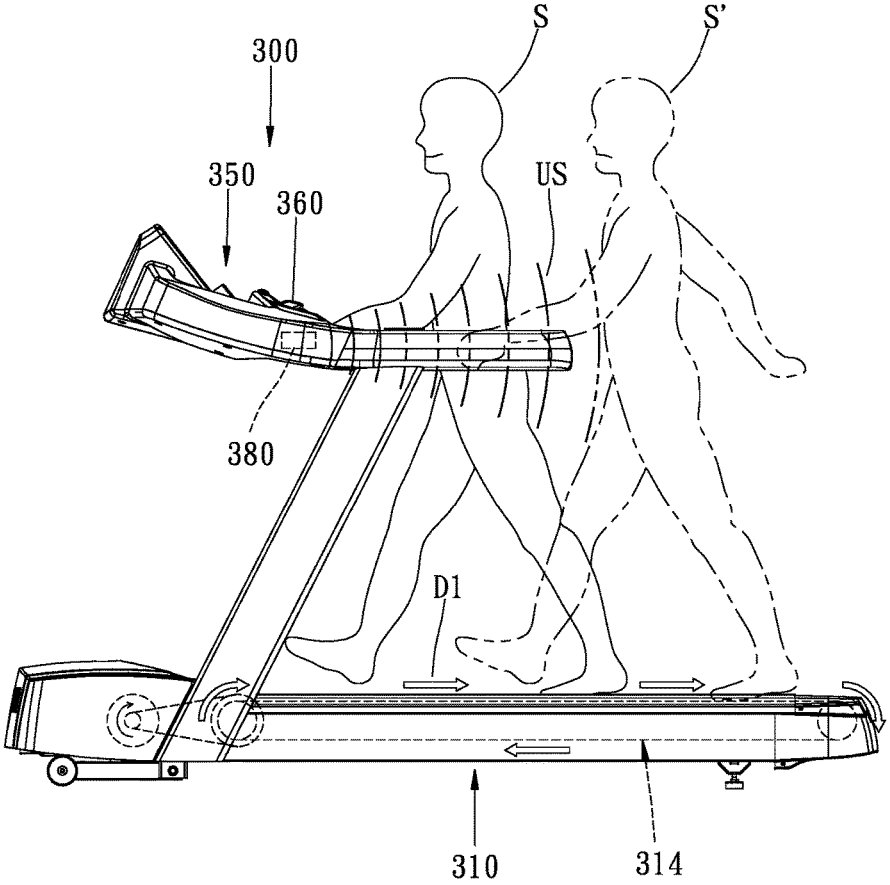
FIG. 7 is a side view of a treadmill in accordance with a third preferred embodiment of the present invention for illustrating that the treadmill is operated in a forward movement mode.
Figure 8:
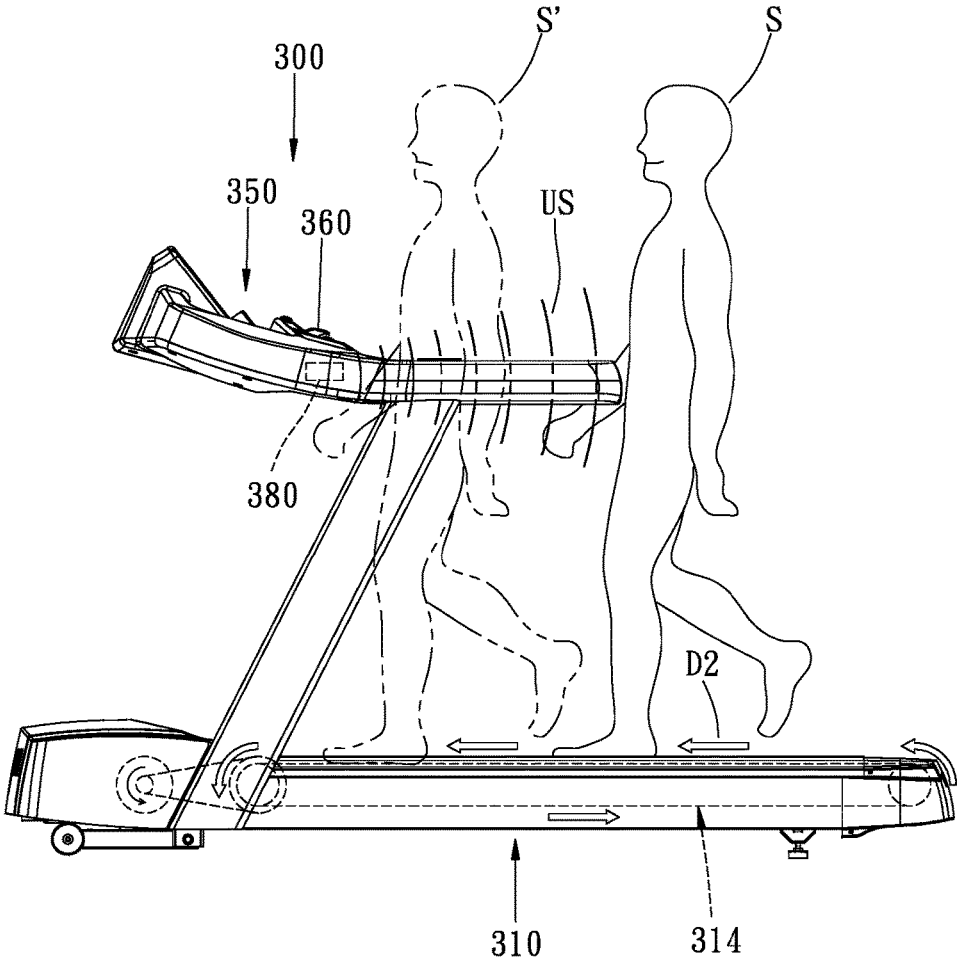
FIG. 8 is a side view of the treadmill shown in FIG. 7 for illustrating that the treadmill is operated in a reverse movement mode.

Referring to FIG. 7 and FIG. 8, a treadmill 300 is illustrated in accordance with a third preferred embodiment of the present invention. The feature of the third embodiment is that an ultrasonic module 380 is disposed at the central position of the rear side of the console 350, such that the ultrasonic module 380 can emit ultrasound (US) rearward. The ultrasound (US) will be reflected back as an object in the path of the ultrasound (US) within a distance and received by the ultrasonic module 380 so as to obtain the distance of the object by measuring the elapsed time of the ultrasound (US) reflected back to the ultrasonic module 380. In this application, it is able to determine a distance between the exerciser S and the console 350, that is, to determine the position of the exerciser S on the platform 310. As shown in FIG. 7, when the treadmill 300 is operated in a forward movement mode, the control unit controls the ultrasonic module 380 to emit ultrasound (US), and to monitor the reflection status of the ultrasound (US), namely to monitor the position of the exerciser S. When the control unit determines that the exerciser S backs to a first warning area behind the normal range of movement according to the detection of the ultrasonic module 380 (as shown in the phantom lines of the exerciser's location S' in FIG. 7), the control unit will control the driving device to stop running. As shown in FIG. 8, when the treadmill 300 is operated in a forward movement mode, the control unit controls the ultrasonic module 380 to emit ultrasound (US) as well, and to monitor the reflection status of the ultrasound (US). When the control unit determines that the exerciser S enters into a second warning area in front of the normal range of movement according to the detection of the ultrasonic module 380 (as shown in the phantom lines of the exerciser's location S' in FIG. 8), the control unit will control the driving device to stop running. Accordingly, the present embodiment has both the first detecting function and the second detecting function. Since the ultrasonic module 380 is also detected in the forward movement mode, the treadmill 300 of the present embodiment does not need to be provided with the aforementioned safety clip set. The treadmill 300 of the present embodiment is still provided with an emergency switch 360 for allowing the exerciser S to stop the treadmill 300 actively in both movement modes in an emergency.

In the present embodiment, the detecting device (namely the ultrasonic module 380) is capable of knowing the position of the exerciser S on the platform 310 rather than knowing the position as the exerciser S has reached or crossed a particular position. The treadmill 300 of the present embodiment may be further designed such that, in a forward movement mode, when the detecting device detects that the exerciser S backs to a first pre-warning area which is slightly more forward than the first warning area, that is, although the position of the exerciser S is behind the normal range of movement but it still has no need to stop operation of the treadmill immediately, the control unit will control the driving device to slow down the endless belt so that the exerciser S has an opportunity to speed up the walking or running speed to return to the normal range of movement. If the detecting device detects that the exerciser S has moved forward and away from the first pre-warning area, the rotational speed of the endless belt is controlled to return to the previous speed. If the detecting device detects that the exerciser S continues to back to the first warning area, the endless belt is controlled to stop immediately. In contrast, in the reverse movement mode, when the detecting device detects that the exerciser S moves forward to a second pre-warning area which is slightly more rearward than the second warning area, that is, although the position of the exerciser S is ahead of the normal range of movement but it still has no need to stop operation of the treadmill immediately, the control unit will control the driving device to slow down the endless belt so that the exerciser S has an opportunity to speed up the backward walking speed to return to the normal range of movement. If the detecting device detects that the exerciser S has moved backward and away from the second pre-warning area, the rotational speed of the endless belt is controlled to return to the previous speed. If the detecting device detects that the exerciser S continues to move forward to the second warning area, the endless belt is controlled to stop immediately.

In the present embodiment, the ultrasonic module 380 works in either forward movement mode or reverse movement mode, that is, the ultrasonic module 380 will emit and receive ultrasound (US) to monitor the position of the exerciser S. However, in the forward movement mode, it is more dangerous when the exerciser S is located more rearward. In contrast, in the rearward movement mode, it is more dangerous when the exerciser S is located more frontward. Therefore, the control unit controls the driving device to slow down the endless belt or stop operation as "the exerciser enters the first warning area (including the pre-warning area)" in the forward movement mode and to slow down the endless belt or stop operation as "the exerciser enters to second warning area (including the pre-warning area)" in the rearward movement mode. The two reaction mechanisms are different and not enabled at the same time.

According to one aspect of the present invention, in a particular embodiment, the control unit of the present treadmill has two reaction mechanisms. When it is determined that the exerciser enters into a first warning area which is preset at the rear portion above the platform according to a first detecting device or first detecting function, the control unit will control the driving device to slow down or stop operation of the endless belt, called "rear-end warning mechanism". Besides, when it is determined that the exerciser enters into a second warning area which is preset at the front portion above the platform according to a second detecting device or second detecting function, the control unit will control the driving device to slow down or stop operation of the endless belt, called "front-end warning mechanism". The aforementioned two reaction mechanisms can be respectively controlled by the control unit to enable or disable depending to situations. For example, when the treadmill is operated in the forward movement mode, the control unit will enable the rear-end warning mechanism and disable the front-end warning mechanism. In contrast, when the treadmill is operated in the rearward movement mode, the control unit will enable the front-end warning mechanism and disable the rear-end warning mechanism. In the embodiment in which the emergency switch is provided, the control unit controls the driving device to stop operation as the emergency switch is triggered, called "emergency switch reaction mechanism". Preferably, the emergency switch is enabled in both the forward movement mode and the rearward movement mode.

Figure 9:
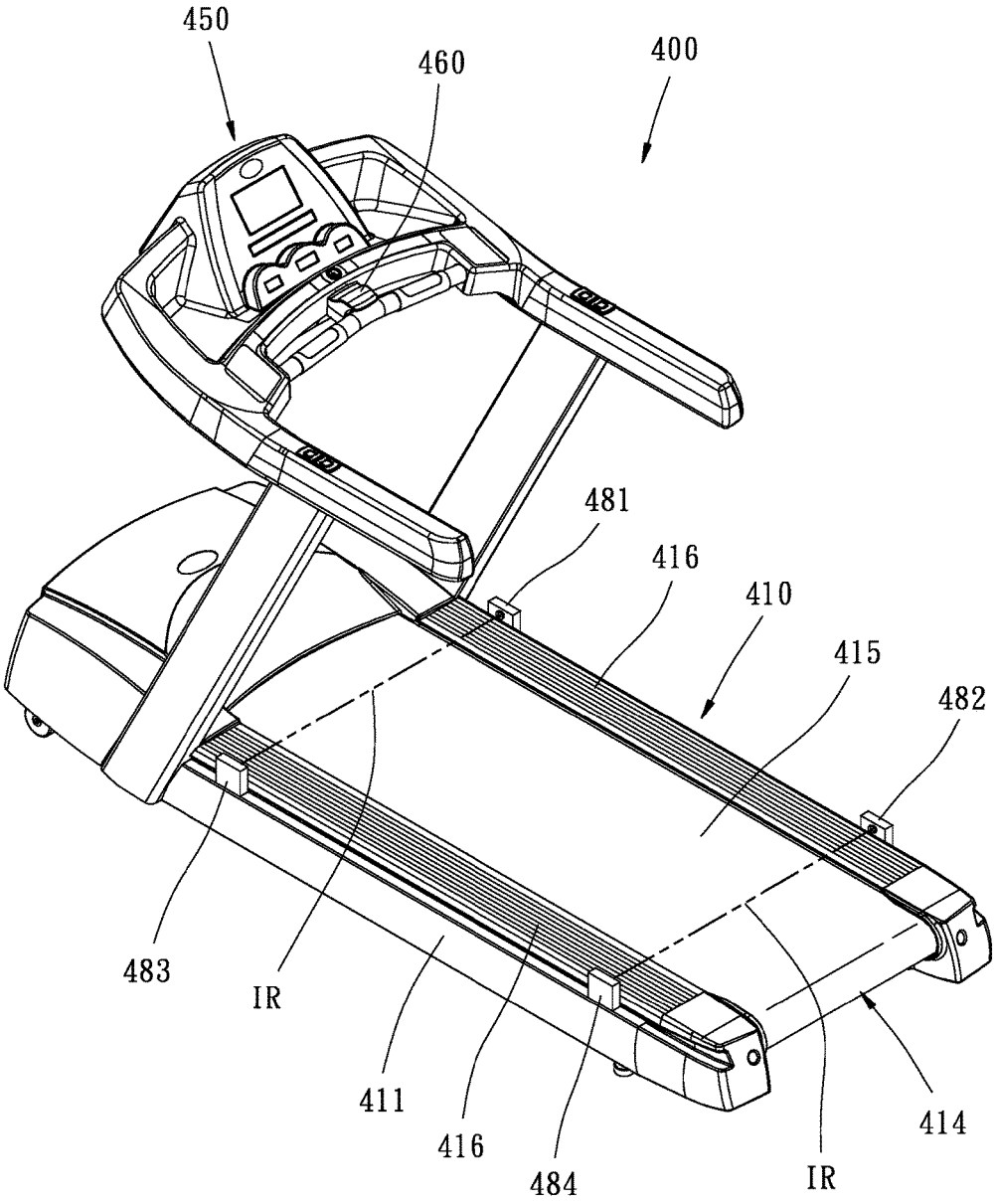
FIG. 9 is a perspective view of a treadmill in accordance with a fourth preferred embodiment of the present invention.

Referring to FIG. 9, a treadmill 400 is illustrated in accordance with a fourth preferred embodiment of the present invention. The feature of the treadmill 400 is that there are two pairs of infrared sets disposed on opposite sides of the platform 410. A front infrared emitter 481 and a rear infrared emitter 482 are disposed on a right side of the frame 411 and arranged at an outside of the right side rail 416. A front infrared receiver 483 and a rear infrared receiver 484 are disposed on a left side of the frame 411 and arranged at an outside of the left side rail 416. The front infrared emitter 481 and the front infrared receiver 483 are opposite to each other. The rear infrared emitter 482 and the rear infrared receiver 484 are opposite to each other. Each pair of infrared set can generate an infrared ray (IR) across the exercise surface 415. The infrared ray (IR) is slightly higher than the exercise surface 415, which can be interrupted by the foot of the exerciser on the exercise surface 415 at the corresponding position. The infrared ray (IR) near the rear end of the exercise surface 415 is used to detect whether the exerciser enters a first warning area, which is only operated in the forward movement mode. The infrared ray (IR) near the front end of the exercise surface 415 is used to detect whether the exerciser enters a second warning area, which is only operated in the reverse movement mode.

In the aforementioned embodiments, both the first warning area and the second warning area are located at the space above the exercise surface. The first warning area is located more rearward than the center of the exercise surface, and the second warning area is located more forward than the center of the exercise surface. In another embodiment (not shown), the second warning area may be set in front of the space above the exercise surface, for example, as mentioned before, an infrared emitter may be disposed at the bottom of the console 150 and a corresponding infrared receiver may be disposed at the top of the protecting cover 116 so as to generate a longitudinal infrared ray for detecting whether the exerciser enters the top of the protecting cover in the reverse movement mode. Additionally, the present invention may provide a pressure sensor on the protecting cover, and the control unit controls to stop the endless belt in reverse rotation as the exerciser steps on the protecting cover.

In addition to the aforementioned embodiment, there are other methods to detect whether the exerciser enters a preset warning area. For example, a pressure sensor may be disposed on a front/rear end area of a top plane of a rectangular deck (or running board) under the exercise surface for sensing whether such area is stepped by the exerciser. A pressure sensor may be coupled to an elastic support member that is provided for supporting the rectangular deck and configured to detect the stepping position of the exerciser according to the force acting on the supporting member. An ultrasonic module is arranged on the rear end of the treadmill and configured to emit ultrasound forward so as to determine the position of the exerciser according to the reflection of the ultrasound. Also, the mechanism of the aforementioned safety clip set can move to the rear end of the treadmill for detecting whether exerciser is located more forward in the reverse movement mode. Additionally, a cord winder may be provided in the treadmill, for example, a cord may have one end connected to a clip member that could be attached to the exerciser and the other end connected to the cord winder, so that it is able to monitor the pull-out length of the cord to determine the position of the exerciser.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A treadmill which can be driven in both directions, comprising:

a platform having a frame and an endless belt mounted around the frame, the endless belt defining an exercise surface which is slidable in a longitudinal direction for allowing a user to perform walking or running, the platform defining a warning area located more forward than a center of the exercise surface;

a driving device having a motor coupled to the endless belt for driving the endless belt to rotate;

a detecting device for detecting whether the user enters the warning area or not; and a control unit electrically connected to the driving device and the detecting device, the control unit configured to control the driving device to drive the endless belt to rotate in a predetermined rotational direction at a predetermined rotational speed, the control unit having a reaction mechanism such that when the detecting device detects that the user enters into the warning area, the control unit controls the driving device to slow down or stop the endless belt;

wherein, the treadmill is capable of being selected to be operated in a forward movement mode or in a reverse movement mode; in the forward movement mode, the control unit controls the driving device to drive the exercise surface of the endless belt to slide backward and to disable the reaction mechanism; and in the reverse movement mode, the control unit controls the driving device to drive the exercise surface of the endless belt to slide forward and enable the reaction mechanism.

2. The treadmill as claimed in claim 1, wherein the warning area is located at a space above the exercise surface.

3. The treadmill as claimed in claim 1, wherein the control unit further comprises another reaction mechanism which is enabled in the forward movement mode, when receiving a signal, the control unit controls the driving device to slow down or stop the endless belt.

4. A treadmill which can be driven in both directions, comprising:

a platform having a frame and an endless belt mounted around the frame, the endless belt defining an exercise surface which is slidable in a longitudinal direction for allowing a user to perform walking or running, the platform defining a warning area located more forward than a center of the exercise surface;

a driving device having a motor coupled to the endless belt for driving the endless belt to rotate;

an emergency switch disposed above the platform for allowing the user to actuate by hands;

a detecting device for detecting whether the user enters the warning area or not; and a control unit electrically connected to the driving device, the emergency switch and the detecting device, the control unit configured to control the driving device to drive the endless belt to rotate in a predetermined rotational direction at a predetermined rotational speed, the control unit having a first reaction mechanism and a second reaction mechanism, wherein the first reaction mechanism is such that when the emergency switch is enabled, the control unit controls the driving device to slow down or stop the endless belt, and the second reaction mechanism is such that when the detecting device detects that the user enters into the warning area, the control unit controls the driving device to slow down or stop the endless belt;

wherein, the treadmill is capable of being selected to be operated in a forward movement mode or in a reverse movement mode; in the forward movement mode, the control unit controls the driving device to drive the exercise surface of the endless belt to slide backward and to enable the first reaction mechanism and disable the second reaction mechanism; in the reverse movement mode, the control unit controls the driving device to drive the exercise surface of the endless belt to slide forward and enable both the first reaction mechanism and the second reaction mechanism.

5. The treadmill as claimed in claim 4, wherein the warning area is located at a space above the exercise surface.

6. A treadmill which can be driven in both directions; comprising:

a platform having a frame and an endless belt mounted around the frame, the endless belt defining an exercise surface which is slidable in a longitudinal direction for allowing a user to perform walking or running, the platform defining a first warning area and a second warning area, the first warning area located more rearward than a center of the exercise surface, the second warning area located more forward than the center of the exercise surface;

a driving device having a motor coupled to the endless belt for driving the endless belt to rotate;

a detecting unit having a first detecting function for detecting whether the user enters the first warning area or not, and a second detecting function for detecting whether the user enters the second warning area or not; and a control unit electrically connected to the driving device and the detecting device, the control unit configured to control the driving device to drive the endless belt to rotate in a predetermined rotational direction at a predetermined rotational speed, the control unit having a first reaction mechanism and a second reaction mechanism, wherein the first reaction mechanism is such that when the first detecting function detects that the user enters into the first warning area, the control unit controls the driving device to slow down or stop the endless belt, and the second reaction mechanism is such that when the second detecting function detects that the user enters into the second warning area, the control unit controls the driving device to slow down or stop the endless belt;

wherein, the treadmill is capable of being selected to be operated in a forward movement mode or in a reverse movement mode; in the forward movement mode, the control unit controls the driving device to drive the exercise surface of the endless belt to slide backward and to enable the first reaction mechanism and disable the second reaction mechanism; in the reverse movement mode, the control unit controls the driving device to drive the exercise surface of the endless belt to slide forward and enable the second reaction mechanism and disable the first reaction mechanism.

7. The treadmill as claimed in claim 6, wherein both the first warning area and the second warning area are located at a space above the exercise surface.

8. The treadmill as claimed in claim 6, wherein the detecting unit has two detecting devices, one detecting device has the first detecting function and the other detecting device has the second detecting function.

9. The treadmill as claimed in claim 6, wherein the detecting unit has a detecting device having both the first detecting function and the second detecting function.

10. The treadmill as claimed in claim 6, further comprising an emergency switch disposed above the platform for allowing the user to actuate by hands, the emergency switch being electrically connected to the control unit, when the emergency switch is enabled, the control unit controls the driving device to slow down or stop the endless belt in the forward movement mode or in the reverse movement mode.

* * * * *